US008418317B2

(12) United States Patent
Wu et al.

(10) Patent No.: US 8,418,317 B2
(45) Date of Patent: Apr. 16, 2013

(54) HINGE WITH DAMPING DEVICE

(75) Inventors: Yi Tai Wu, Jiangsu (CN); Hsin Hung Lin, Jiangsu (CN); Shu Hua Lin, Jiangsu (CN); Shu Jiuan Lin, Jiangsu (CN)

(73) Assignee: Kunshan Huhua Metal Products Co., Ltd., Jiangsu (CN)

( * ) Notice: Subject to any disclaimer, the term of this patent is extended or adjusted under 35 U.S.C. 154(b) by 309 days.

(21) Appl. No.: 13/010,840

(22) Filed: Jan. 21, 2011

(65) Prior Publication Data

US 2012/0174338 A1 Jul. 12, 2012

(30) Foreign Application Priority Data

Jan. 12, 2011 (CN) ..... 2011 1 0005502

(51) Int. Cl.
*E05F 3/20* (2006.01)

(52) U.S. Cl.
USPC ..... 16/50; 16/277; 16/308

(58) Field of Classification Search ..... 16/50, 68, 16/75, 277, 308
See application file for complete search history.

(56) References Cited

U.S. PATENT DOCUMENTS

| | | | | |
|---|---|---|---|---|
| 5,617,612 | A | 4/1997 | Ferrari et al. | |
| 6,470,531 | B2 * | 10/2002 | Domenig et al. | 16/240 |
| 6,643,895 | B1 * | 11/2003 | Domenig et al. | 16/238 |
| 6,845,544 | B2 * | 1/2005 | Hofer | 16/246 |
| 6,880,205 | B2 * | 4/2005 | Rupprechter | 16/235 |
| 7,096,535 | B2 * | 8/2006 | Lin | 16/287 |
| 7,117,561 | B1 * | 10/2006 | Domenig et al. | 16/236 |
| 7,516,516 | B2 * | 4/2009 | Wu | 16/242 |
| 7,653,967 | B2 * | 2/2010 | Lowe et al. | 16/238 |
| 7,832,054 | B2 | 11/2010 | Nakasone | |
| 7,841,049 | B2 | 11/2010 | Wang | |
| 7,841,051 | B2 | 11/2010 | Wu | |
| 2008/0271292 | A1 * | 11/2008 | Lowe et al. | 16/238 |
| 2010/0269294 | A1 | 10/2010 | Krammer | |

* cited by examiner

*Primary Examiner* — Roberta Delisle
(74) *Attorney, Agent, or Firm* — Alan Kamrath; Kamrath IP Lawfirm, P.A.

(57) ABSTRACT

A hinge includes a base, an arm, a mounting member, a hinge spring, a fixing pin member, and a damping device. Two ends of the arm are pivotably connected to the base and the mounting member, with the hinge spring exerting elastic force on the base and the arm. The damping device is mounted in the base and includes a fixed seat mounted in the base, a sliding block movably received in the fixed seat, a damping member mounted between the sliding block and the fixing pin member and abutting the base, and an elastic element. The sliding block includes a front portion facing the arm and a rear portion connected to the elastic element pressing against the fixed seat.

8 Claims, 6 Drawing Sheets

HINGE WITH DAMPING DEVICE

BACKGROUND OF THE INVENTION

1. Field of the Invention

The present invention relates to a hinge with a damping device and, more particularly, to a furniture hinge providing damping effect while a door is being closed relative to a cabinet body, reducing noise resulting from impact to the cabinet body.

2. Description of the Related Art

U.S. Patent Publication No. 2010/0269294 entitled "HINGE HAVING A DAMPING DEVICE" discloses a hinge including a hinge arm, a hinge cup hingedly connected to the hinge arm, an actuating element pivotably received in the hinge cup, a damping device in the form of a rotational damper operatively connected to the actuating element and mounted to a lateral outside wall of the hinge cup, and a return mechanism mounted to the other lateral outside wall of the hinge cup opposite to the damping device. The damping device includes a damper housing fixed to the lateral outside wall of the hinge cup and receives the rotational damper. The return mechanism includes a return element connected to a free end of the actuating element, a journal member engaged in a shaft hole of the hinge cup, a spring device for providing returning force, and a return housing enclosing the elements of the return mechanism. The damping device and the return mechanism are separate from each other and located on opposite lateral outside walls of the hinge cup. However, the hinge structure is relatively complicated and, thus, causes an increase in costs of assemblage and parts. Furthermore, the damping liquid in the rotational damper is liable to leak after a period of time.

Thus, a need exists for a novel hinge avoiding the above disadvantages.

SUMMARY OF THE INVENTION

An objective of the present invention is to provide a hinge with damping device. The hinge includes a base and an arm. The base includes a recessed body for receiving the damping device to provide damping force while coming in contact with the arm.

According to an aspect of the present invention, a hinge includes a base having a recessed body. The recessed body includes two sidewalls and a bottom wall. An arm includes a pivotal portion connected to a first location of the two sidewalls. The pivotal portion has a cam portion. A mounting member is connected to the arm. A fixing pin member includes a first pin and a second pin preferably parallel to the first pin, and is disposed at the recessed body of the base. The first pin is mounted to the first location of the sidewalls of the base and pivotably connected to the arm. The second pin is mounted to a second location of the sidewalls of the base. A hinge spring includes a first elastic portion, a second elastic portion relative to the first elastic portion, and an intermediate portion interconnected between the first and second elastic portions. The first elastic portion presses against the cam portion of the arm. The second elastic portion presses against the base. The intermediate portion receives the second pin of the fixing pin member. A damping device includes a fixed seat, a sliding block, a damping member, and an elastic element. The fixed seat is fixedly mounted in the recessed body of the base. The fixed seat includes a receiving space and a stop plate at a rear end of the receiving space. The sliding block is movably received in the receiving space of the fixed seat. The sliding block includes a front portion, a rear portion, and two connecting walls and a top wall connected between the front and rear portions. An elongated through-hole extends through the connecting walls. The front portion faces the arm. The rear portion faces the stop plate of the fixed seat. The second pin of the fixing pin member extends through the elongated through-hole to restrain movement of the sliding block. The damping member is mounted between the bottom wall of the base, the sliding block, and the second pin of the fixing pin member. The elastic element is mounted between the rear portion of the sliding block and the stop plate of the fixed seat. When the base moves relative to the arm to a closed position, the front portion of the sliding block comes in contact with the arm and moves into the fixed seat, such that the damping member is pressed by the second pin of the fixing pin member and the bottom wall of the base to provide primary damping force and that the elastic element is compressed to provide auxiliary damping force and to provide returning force for the sliding block.

Preferably, the receiving space of the fixed seat further includes two lateral plates and a top plate connected between top ends of the lateral plates. The stop plate is connected between rear ends of the lateral plates. The receiving space is defined between the lateral plates, the top plate, and the stop plate. Front ends of the lateral plates include two aligned holes through which the second pin of the fixing pin member extends.

Preferably, the fixed seat includes two protrusions, and the bottom wall of the base includes two hooks engaged with the two protrusions for positioning.

Preferably, the sliding block includes a damping compartment in alignment with the front portion and the elongated through-hole. The damping member is received in the damping compartment.

Preferably, the front portion of the sliding block includes a protruded rib facing the arm.

Preferably, the rear portion of the sliding block includes a rear compartment, and the elastic element is received in the rear compartment.

Preferably, the damping member is a bent, elastic plate includes a first and a second section and a bend connected between the first and second sections. The first and second sections partially extend between the bottom wall of the base and the second pin of the fixing pin member. The bend faces the front portion of the sliding block.

Preferably, the sliding block includes an insertion groove, and the first section of the damping member includes an end bent to form a fixing portion. The fixing portion is relative to the insertion groove and fixedly received in the insertion groove.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
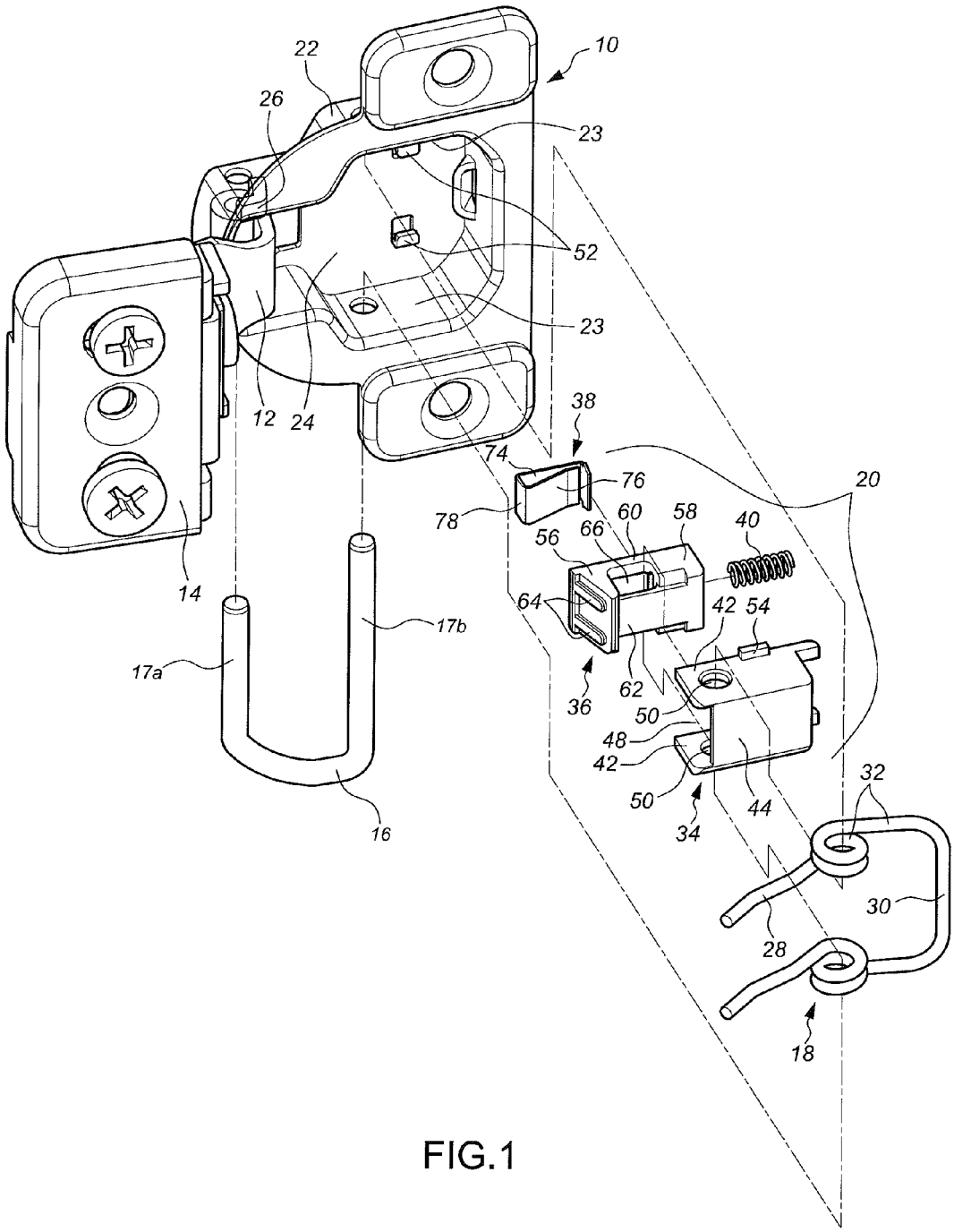
FIG. 1 shows an exploded, perspective view of a hinge according to the present invention.
Figure 2:
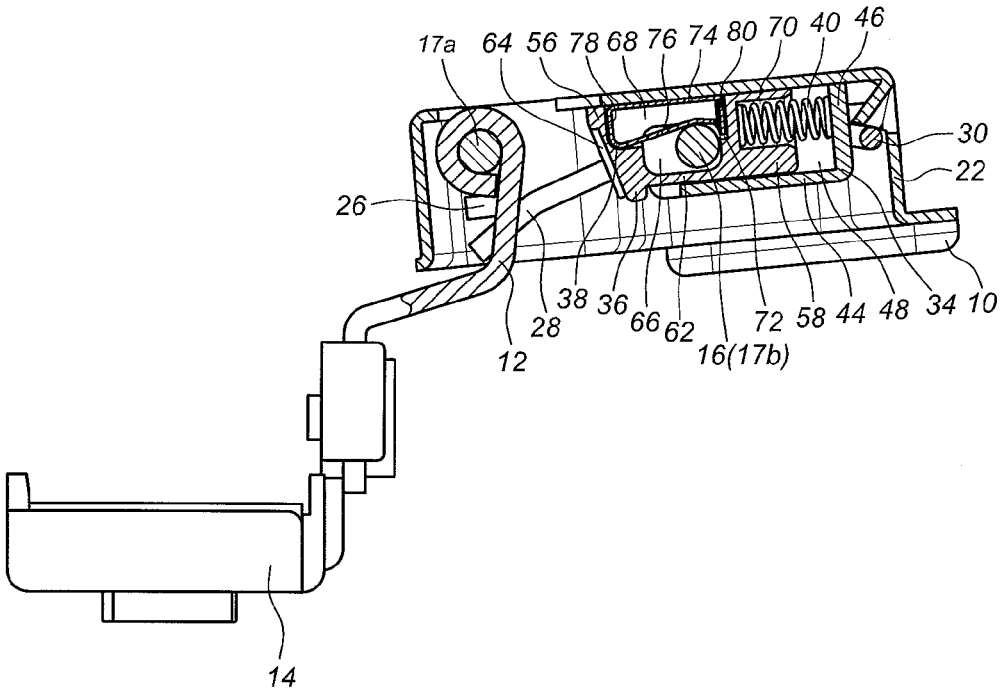
FIG. 2 shows a cross sectional view of the hinge of FIG. 1.

FIGS. 1 and 2 show a hinge of a preferred embodiment according to the present invention. The hinge includes a base 10, an arm 12, a mounting member 14, a fixing pin member 16, a hinge spring 18, and a damping device 20.

The base 10 includes a recessed body 22. The recessed body 22 includes two sidewalls 23 and a bottom wall 24.

The arm 12 is pivotably connected to a first location of the sidewalls 23 of the base 10. The arm 12 includes a cam portion 26 at the pivotal portion of the arm 12.

The mounting member 14 includes an end connected to the arm 12 and mounted to a piece of furniture such as a cabinet body.

The fixing pin member 16 is substantially a U-shaped member including a first pin 17*a* and a second pin 17*b* preferably parallel to the first pin 17*a*. The first pin 17*a* is mounted to the first location of the sidewalls 23 of the base 10 and pivotably connected to the arm 12, allowing the base 10 to pivot relative to the arm 12 about the first pin 17*a*. The second pin 17*b* is mounted to a second location of the sidewalls 23 of the base 10.

The hinge spring 18 includes a first elastic portion 28, a second elastic portion 30 relative to the first elastic portion 28, and an intermediate portion 32 interconnected between the first and second elastic portions 28 and 30. The first elastic portion 28 presses against the cam portion 26 of the arm 12. The second elastic portion 30 presses against the base 10 at a point adjacent to the recessed body 22. The intermediate portion 32 receives the second pin 17*b*. When the base 10 moves relative to the arm 12 to a certain position (such as the open position or closed position), the hinge spring 18 exerts elastic force on the base 10 and the arm 12 in response to the movement of the base 10, retaining the base 10 and the arm 12 in the certain position.

The damping device 20 includes a fixed seat 34, a sliding block 36, a damping member 38, and an elastic element 40. The fixed seat 34 is fixed in the recessed body 22 of the base 10. The fixed seat 34 includes two lateral plates 42, a top plate 44 connected to top ends of the lateral plates 42, and a stop plate 46 connected to rear ends of the lateral plates 42. The lateral plates 42, the top plate 44, and the stop plate 46 together define a receiving space 48. Front ends of the lateral plates 42 include two aligned holes 50 through which the second pin 17*b* of the fixing pin member 16 extends. A pair of hooks 52 is formed on the bottom wall 24 of the recessed body 22 of the base 10. The lateral plates 42 of the fixed seat 34 include two protrusions 54. The hooks 52 engage with the protrusions 54 to provide positioning. In the preferred embodiment, the fixed seat 34 provides the receiving space 48 for receiving the sliding block 36, the damping member 38, and the elastic element 40. The elastic element 40 presses against the stop plate 46.

Figure 3:
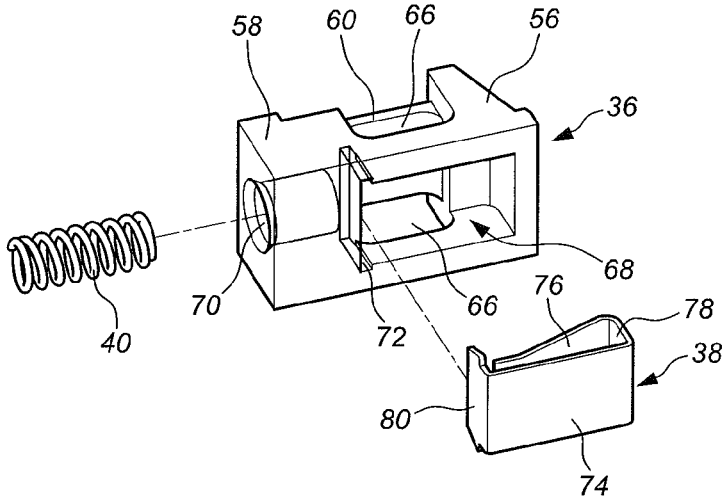
FIG. 3 shows an exploded, perspective view of a damping device of the hinge of FIG. 1.

The sliding block 36 is movably received in the receiving space 48 of the fixed seat 34. The sliding block 36 includes a front portion 56, a rear portion 58 relative to the front portion 56, and two connecting walls 60 and a top wall 62 connected between the front and rear portions 56 and 58. The front portion 56 includes two protruded ribs 64 facing the arm 12. An elongated through-hole 66 extends through the connecting walls 60. A damping compartment 68 is formed in alignment with the front portion 56 and the elongated through-hole 66. The damping compartment 68 receives the damping member 38, as shown in FIG. 3. The rear portion 58 includes a rear compartment 70 receiving the elastic element 40. The elastic element 40 presses against the stop plate 46 of the fixed seat 34. The second pin 17*b* of the fixing pin member 16 is extended through the elongated through-hole 66 of the connecting walls 60, restraining movement of the sliding block 36 relative to the fixed seat 34. Preferably, an insertion groove 72 is defined between the damping compartment 68 and the rear portion 58.

The damping member 38 is mounted in the damping compartment 68 of the sliding block 36 and faces the second pin 17*b* of the fixing pin member 16. Specifically, the damping member 38 is mounted between the bottom wall 24 of the base 10, the sliding block 36, and the second pin 17*b* of the fixing pin member 16. In the preferred embodiment, the damping member 38 is a bent, elastic plate including a first section 74, a second section 76, and a bend 78 connected between the first and second sections 74 and 76. The first and second sections 74 and 76 partially extend between the bottom wall 24 of the base 10 and the second pin 17*b* of the fixing pin member 16. The bent 78 faces the front portion 56 of the sliding block 36. Specifically, the first section 74 is in contact with the bottom wall 24 of the recessed body 22 of the base 10. At least a portion of the second section 76 abuts the second pin 17*b* of the fixing pin member 16. The bend 78 abuts an inner wall of the damping compartment 68 of the sliding block 36. Preferably, an end of the first section 74 is bent to form a fixing portion 80 relative to the insertion groove 72 of the sliding block 36 so that the fixing portion 80 can be fixedly received in the insertion groove 72.

The elastic element 40 is mounted between the rear compartment 70 of the sliding block 36 and the stop plate 46 of the fixed seat 34 such that the sliding block 36 can be moved by elastic force from the elastic element 40.

Figure 4:
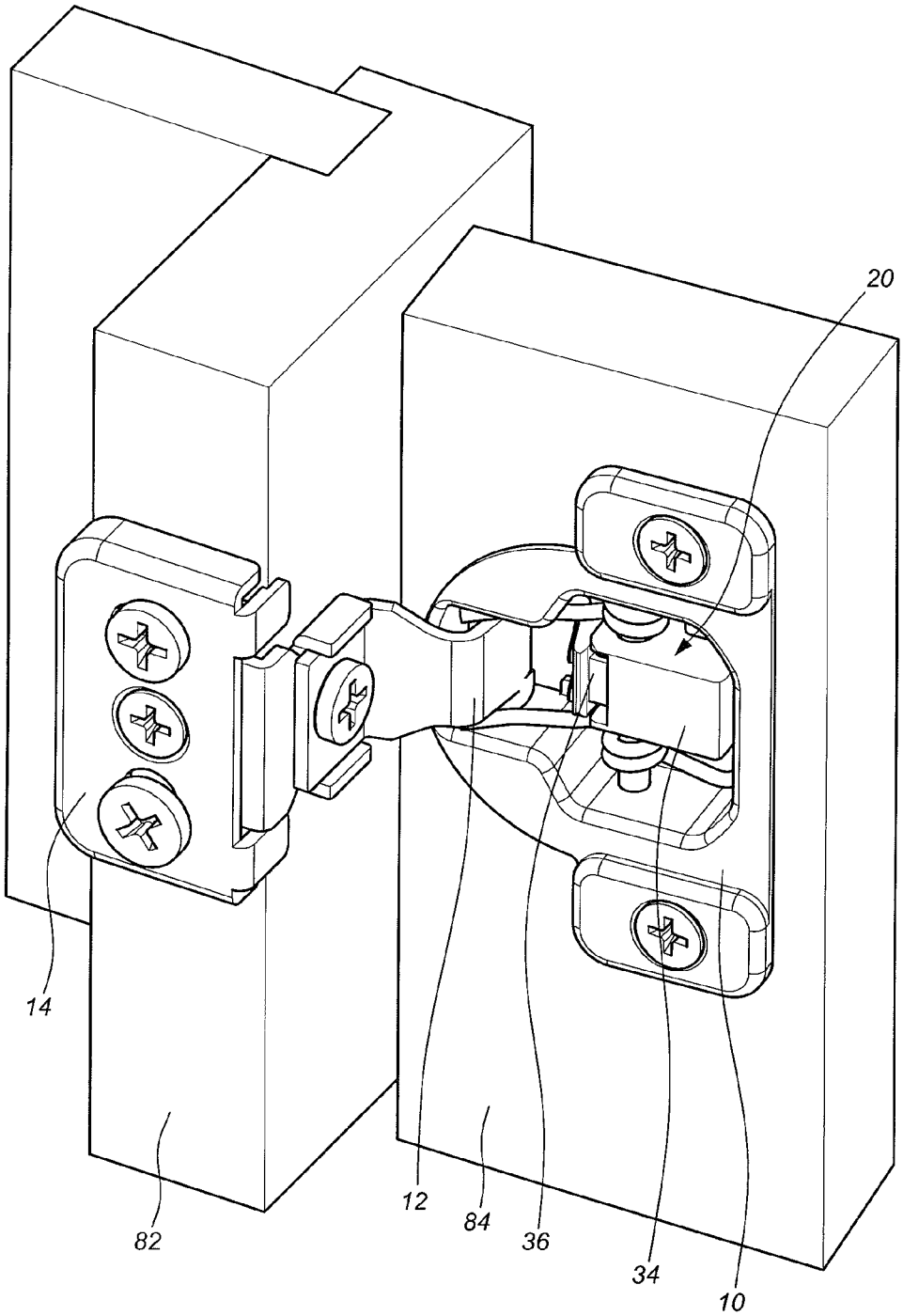
FIG. 4 shows a perspective view of the hinge of FIG. 1 mounted to a cabinet body and a door.
Figure 5:
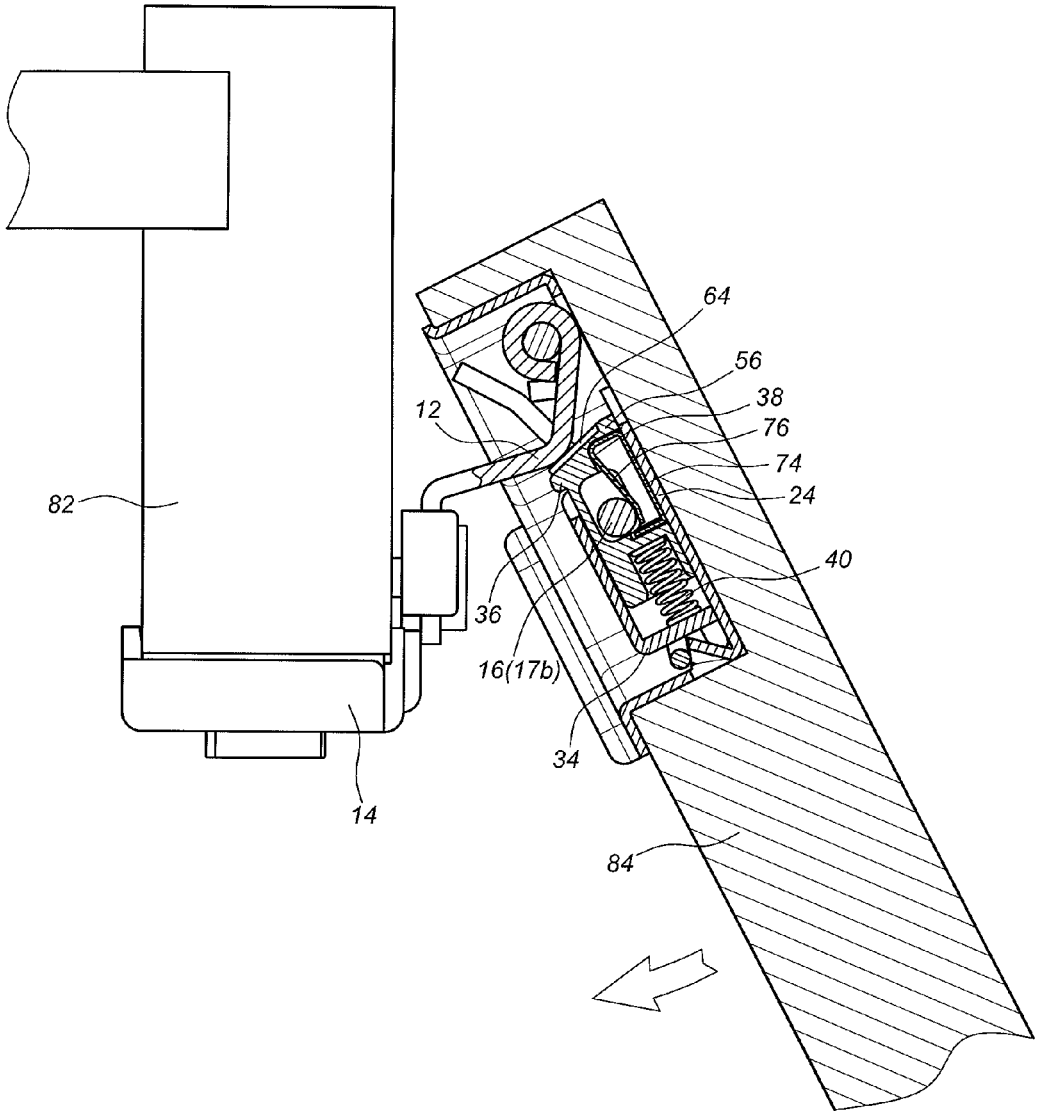
FIG. 5 shows a cross sectional view of the hinge and the door of FIG. 4 with the door being closed and with a hinge arm initially pressing against a sliding block.
Figure 6:
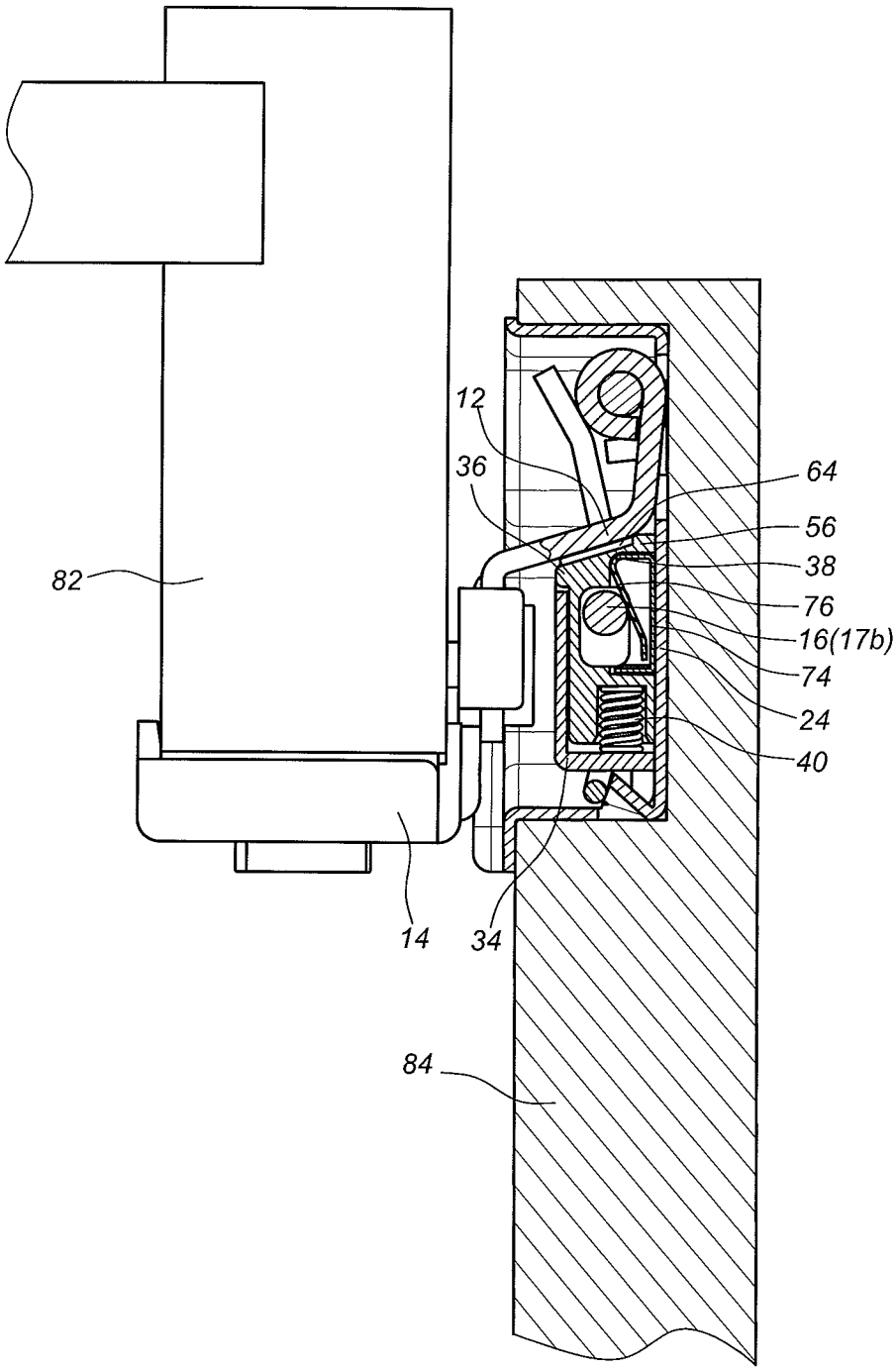
FIG. 6 shows a cross sectional view of the hinge and the door of FIG. 4 with the door in a closed position.

The hinge is mounted to a piece of furniture such as a cabinet. In an example shown in FIG. 4, the mounting member 14 is mounted to a cabinet body 82, and the base 10 is mounted to a door 84. When the door 84 is moved relative to the cabinet body 82 to a closed position (see FIGS. 5 and 6), the arm 12 impacts the protruded ribs 64 at the front portion 56 of the sliding block 36, moving the sliding block 36 into the fixed seat 34. At the same time, the sliding block 36 urges the damping member 38 to presses against the second pin 17*b* of the fixing pin member 16. Thus, the damping member 38 is pressed by the second pin 17*b* of the fixing pin member 16 and the bottom wall 24 of the base 10, providing primary damping force. The elastic element 40 is compressed and provides auxiliary damping force. More specifically, the second section 76 of the damping member 38 will be pressed and deformed by the second pin 17*b* of the fixing pin member 16, providing a damping force to reduce the speed of the arm 12 pressing against the sliding block 36 and slowing the movement of the base 10 relative to the arm 12, providing damping effect. Namely, the door 84 can be closed to the cabinet body 82 in a slow, quiet manner. Furthermore, the movement of the sliding block 36 compresses the elastic element 40 to provide returning force for the sliding block 36.

Figure 7:
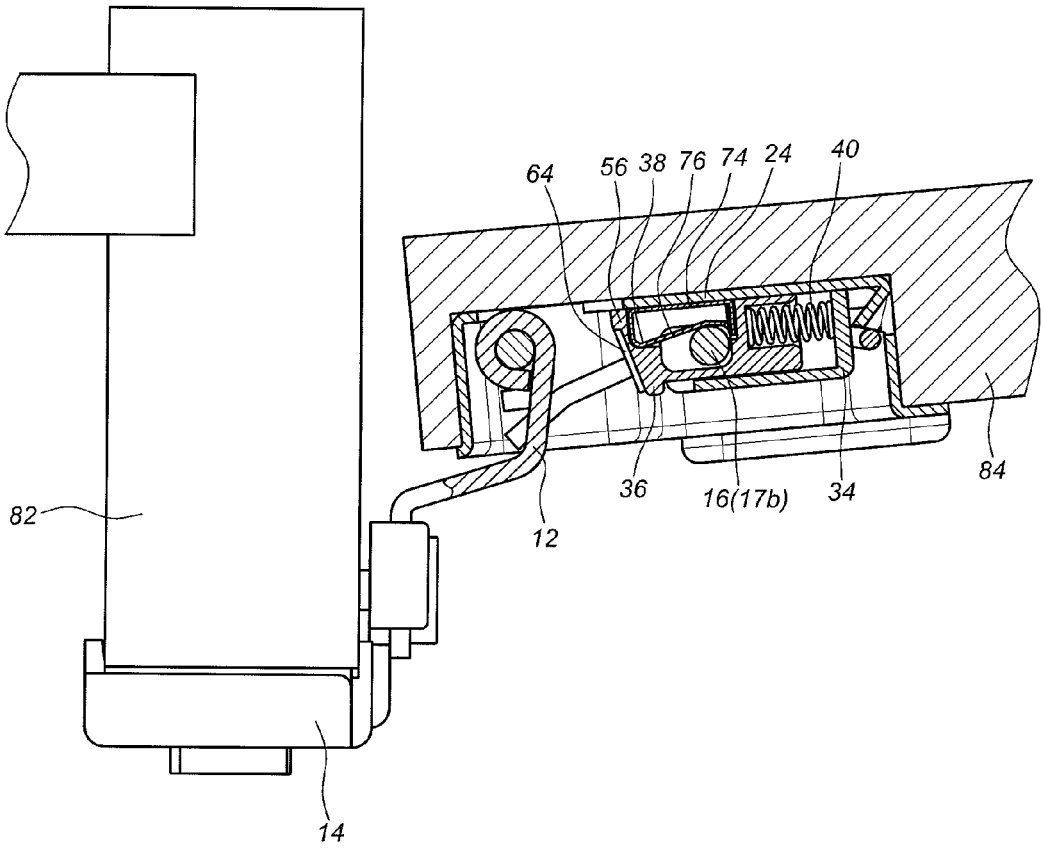
FIG. 7 shows a cross sectional view of the hinge and the door of FIG. 4 with the door in an open position.

FIG. 7 shows that the door 84 is moved relative to the cabinet body 82 to an open position. The arm 12 disengages from the protruded ribs 64 at the front portion 56 of the sliding block 36. The elastic element 40 provides the returning force returning the sliding block 36 and the damping member 38 to their initial positions before being pressed against by the arm 12.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A hinge comprising:

a base including a recessed body, with the recessed body including two sidewalls and a bottom wall;

an arm including a pivotal portion connected to a first location of the two sidewalls, with the pivotal portion having a cam portion;

a mounting member connected to the arm;

a fixing pin member including a first pin and a second pin, with the first pin mounted to the first location of the two sidewalls of the base and pivotably connected to the arm, with the second pin mounted to a second location of the two sidewalls;

a hinge spring including a first elastic portion, a second elastic portion, and an intermediate portion interconnected between the first and second elastic portions, with the first elastic portion pressing against the cam portion, with the second elastic portion pressing against the base, with the intermediate portion receiving the second pin of the fixing pin member; and a damping device including:

a fixed seat fixedly mounted in the recessed body of the base, with the fixed seat including a receiving space and a stop plate at a rear end of the receiving space;

a sliding block movably received in the receiving space of the fixed seat, with the sliding block including a front portion, a rear portion, and two connecting walls and a top wall connected between the front and rear portions, with an elongated through-hole extending through the two connecting walls, with the front portion facing the arm, with the rear portion facing the stop plate of the fixed seat, with the second pin of the fixing pin member extending through the elongated through-hole to restrain movement of the sliding block;

a damping member mounted between the bottom wall of the base, the sliding block, and the second pin of the fixing pin member; and an elastic element mounted between the rear portion of the sliding block and the stop plate of the fixed seat, wherein when the base moves relative to the arm to a closed position, the front portion of the sliding block comes in contact with the arm and moves into the fixed seat, such that the damping member is pressed by the second pin of the fixing pin member and the bottom wall of the base to provide primary damping force and that the elastic element is compressed to provide auxiliary damping force and to provide returning force for the sliding block.

2. The hinge as claimed in claim 1, wherein the fixed seat further includes two lateral plates and a top plate connected between top ends of the two lateral plates, with the stop plate connected between rear ends of the stop plates, the receiving space defined between the two lateral plates, the top plate, and the stop plate, and front ends of the two lateral plates including two aligned holes through which the second pin of the fixing pin member extends.

3. The hinge as claimed in claim 1, wherein the fixed seat includes two protrusions, with the bottom wall of the base including two hooks engaged with the two protrusions for positioning.

4. The hinge as claimed in claim 1, wherein the sliding block includes a damping compartment in alignment with the front portion and the elongated through-hole, with the damping member received in the damping compartment.

5. The hinge as claimed in claim 1, wherein the front portion of the sliding block includes a protruded rib facing the arm.

6. The hinge as claimed in claim 1, wherein the rear portion of the sliding block includes a rear compartment, with the elastic element received in the rear compartment.

7. The hinge as claimed in claim 1, wherein the damping member is a bent, elastic plate including a first and a second section and a bend connected between the first and second sections, with the first and second sections partially extending between the bottom wall of the base and the second pin of the fixing pin member, with the bend facing the front portion of the sliding block.

8. The hinge as claimed in claim 7, wherein the sliding block includes an insertion groove, with the first section of the damping member including an end bent to form a fixing portion relative to the insertion groove, with the fixing portion fixedly received in the insertion groove.

* * * * *